US008905274B2

(12) United States Patent
Sibiet

(10) Patent No.: US 8,905,274 B2
(45) Date of Patent: Dec. 9, 2014

(54) POURING NOZZLE AND ASSEMBLY OF SUCH A POURING NOZZLE WITH AN INNER NOZZLE

(75) Inventor: Fabrice Sibiet, Colleret (FR)

(73) Assignee: Vesuvius Group S.A., Ghlin (BE)

( * ) Notice: Subject to any disclaimer, the term of this patent is extended or adjusted under 35 U.S.C. 154(b) by 292 days.

(21) Appl. No.: 13/503,222

(22) PCT Filed: Oct. 20, 2010

(86) PCT No.: PCT/EP2010/006410

§ 371 (c)(1), (2), (4) Date: Apr. 20, 2012

(87) PCT Pub. No.: WO2011/047850

PCT Pub. Date: Apr. 28, 2011

(65) Prior Publication Data

US 2012/0211531 A1 Aug. 23, 2012

(30) Foreign Application Priority Data

Oct. 21, 2009 (EP) ..... 09173696

(51) Int. Cl.
*B22D 41/50* (2006.01)
*B22D 41/22* (2006.01)

(52) U.S. Cl.
CPC ..... *B22D 41/22* (2013.01); *B22D 41/50* (2013.01)
USPC ..... 222/606; 222/600; 266/236

(58) Field of Classification Search
CPC ..... B22D 41/50; B22D 41/22; B22D 41/24; B22D 41/28
USPC ..... 266/236; 222/600, 606, 607
See application file for complete search history.

(56) References Cited

U.S. PATENT DOCUMENTS

| | | | | |
|---|---|---|---|---|
| 3,779,431 | A * | 12/1973 | Tinnes et al. | 222/600 |
| 5,494,201 | A | 2/1996 | Szadkowski | |
| 5,866,022 | A * | 2/1999 | Hall | 222/600 |
| 7,171,326 | B2 | 1/2007 | Gerber et al. | |

FOREIGN PATENT DOCUMENTS

| | | |
|---|---|---|
| EP | 0192019 B1 | 8/1990 |
| GB | 2160803 A | 1/1986 |
| GB | 2160952 A | 1/1986 |
| WO | 03/041894 A2 | 5/2003 |

* cited by examiner

*Primary Examiner* — Scott Kastler
(74) *Attorney, Agent, or Firm* — Thomas Clinton; Donald M. Satina

(57) ABSTRACT

A pouring nozzle includes a generally rectangular shaped plate and a tube extending from the bottom surface of the plate. The nozzle includes a pouring channel emerging close to the downstream end of the tube through outlets formed in the lateral walls of the tube. The outlets are disposed symmetrically on either side of the axis of the tube. The axis of the outlets is substantially parallel to a pair of sides of the plate. The orifice is oblong and has a major axis and a minor axis. The minor axis of the orifice is parallel to the axis of the outlets. The pouring nozzle may be assembled with an inner nozzle. This nozzle and its assembly with an inner nozzle may be used for the continuous casting of steel from a tundish towards a continuous casting mould.

8 Claims, 1 Drawing Sheet

POURING NOZZLE AND ASSEMBLY OF SUCH A POURING NOZZLE WITH AN INNER NOZZLE

BACKGROUND OF THE INVENTION (1) Field of the Invention

The present invention relates to a refractory element used for the continuous casting of molten steel from an upstream metallurgical vessel to a downstream metallurgical vessel.

According to a particular embodiment of the invention, the nozzle is used for casting molten steel from a distribution tank (sometimes also called a tundish) to a casting mould or ingot mould (sometimes also called a coquille).

(2) Description of Related Art

In the continuous casting of steel from the tundish to an ingot mould, a pouring nozzle is used to protect the liquid steel from chemical attacks from the surrounding atmosphere and to isolate it thermally during its transfer from the upstream vessel to the downstream vessel. These nozzles, roughly cylindrical in shape, consist of a single piece having an upstream end possessing a generally tapered inlet disposed in the vicinity of the bottom of the upstream vessel. These nozzles are pierced right through by a bore forming a pouring channel enabling liquid steel to flow towards the downstream end of the nozzle, which is immersed in the ingot mould. In the majority of cases, the bottom end of the nozzle is closed or at the very least is provided with a restriction in order to limit the vertical flow of the jet of steel and the steel emerges in the ingot mould mainly through lateral openings (also called outlets) with which the downstream end of the nozzle is provided. In the context of the present invention, the term a "closed" bottom end of a nozzle will be used in order to designate either nozzles that are actually closed at their bottom end or simply provided with such a restriction. In the case of the casting of steel as flat products, such as slabs, an ingot mould is used, which is a bottomless mould having four lateral walls, generally made from copper, water cooled, parallel in pairs, and which has a roughly rectangular-shaped cross section corresponding approximately to the width and thickness of the slab. The ingot mould has a length substantially greater than its width. The lateral openings in the bottom part of the nozzle are normally disposed symmetrically with respect to one another to allow homogeneous flow in the ingot mould. In addition, the lateral openings never exactly emerge facing the long walls of the ingot mould, which are also closest to the nozzle, without which the liquid steel discharged from the tundish and therefore still at high temperature would directly come into contact with the long walls, and would cause excessive heating and, after a certain amount of time, the melting of the copper walls. The result would be a leakage of steel with disastrous consequences both for the plant and for the personnel. On the contrary, the lateral openings of the openings of the nozzle are oriented towards the narrow walls of the ingot mould, which are also the furthest away; thus the steel discharged from the tundish has time to cool in contact with the previously poured steel before reaching the walls.

Such pouring nozzles are wearing parts highly stressed to the point that their service life may limit the pouring time. In particular, these nozzles may be clogged by deposits of alumina, eroded chemically by particularly aggressive slag or grade of steel, or cracked by a thermal or mechanical shock. Thus, since the 1980s, devices for supplying and exchanging nozzles have been developed.

In these devices, the submerged entry nozzle, up until then consisting of a single piece and extending from the bottom wall of the tundish as far as the heart of the ingot mould, is replaced by an assembly comprising an inner nozzle (corresponding to the top portion of the submerged entry nozzle) conveying the steel through the bottom wall of the tundish, and a pouring nozzle (corresponding to the bottom portion of the submerged entry nozzle) for transferring steel into the ingot mould. In general, the inner nozzle and the pouring nozzle consist of a single piece, but they may also result from an assembly for example of a plate and tube. The plate may also be cast around a prefabricated tube. In the pouring position, the pouring channels of the inner nozzle and of the pouring nozzle fluidly communicate. The downstream end of the inner nozzle consists of a plate provided with an orifice and which can be applied sealingly against another plate also provided with an orifice constituting the upstream end of the pouring nozzle. The two plates ensure firstly the tightness of the connection between the two nozzles and secondly the sliding of the pouring nozzle from a standby position to a pouring position. These plates are generally rectangular in shape so as to be able to slide in the guide system. In the context of the present description, reference will be made to this general rectangular shape even if in practice the plate deviates from this shape, for example if it has rounded or truncated corners. In all cases, the plate will be circumscribed by a rectangle that has four sides intersecting each other at right angles and the opposite sides of which are parallel in pairs. By the way, it should be noted that the pouring nozzle slides in the guide systems in a direction parallel to a pair of sides that also corresponds to the direction given by an axis passing at the centre of gravity of the lateral openings (the axis of the outlets). It will also be noted that, in some cases, the lateral openings of the nozzle are offset intentionally so that they are not exactly oriented towards the narrow walls of the ingot mould. For example, the axis of the outlets can be offset by up to 25° in order to promote the circulation of steel in the ingot mould in order to improve the homogeneity of the cast product. The device for supplying and exchanging nozzles can also be offset in order to avoid interference at this device. In this case, if it is wished to keep the axis of the outlets strictly parallel to the axis of the ingot mould, it will be necessary to offset this axis with respect to the direction of sliding in the guide system. In the context of the present invention, when a direction is defined with respect to the axis of the outlets, it will be kept in mind that this direction may vary from −25° to +25°. Thus, when it is said of a direction that it is parallel to the axis of the outlets, it will be necessary to understand that this direction is parallel to, within 25°, the axis of the outlets.

In a plant using such devices for supplying and exchanging nozzles, the pouring is carried out through the inner nozzle and a first pouring nozzle, the bores of which communicate. When the pouring nozzle in the pouring position must be replaced, the device slides a new pouring nozzle, up till then in the standby position, on a system of guides comprising guide rails towards the pouring position. During this sliding, the new pouring nozzle drives away the pouring nozzle to be replaced. During the sliding, the plate forming the upstream end of the pouring nozzle comes in line with the pouring channel of the inner nozzle and closes it off. European patent EP-B1-192019 represents such a device. This device has perfectly met the requirements of the market and has afforded a significant extension in the lengths of the casting sequences.

In the majority of cases, the regulation of the flow of poured steel and in particular the interruption of the pouring at the end of the pouring sequence is achieved by means of a stopper rod actuated from the top of the tundish, the body of which passes through the liquid steel bath and the nose of which is adapted to close off the inlet of the inner nozzle.

It sometimes happens that the casting operators are confronted with emergency situations in which it is necessary to interrupt the pouring without the slightest delay. For example, in the case of breakage of the stopper rod or any incident during the casting operations. The prior art recommends in this case the use of a blind plate taking the place of the new nozzle. When the blind plate arrives in the pouring position (which should rather be called the closure position), the downstream orifice of the inner nozzle is thus obstructed by said plate and the pouring sequence is interrupted. To deal with an emergency situation, the pouring operators generally leave this blind plate permanently in the standby position on the guide system in order to be able to slide it into the closure position immediately if needed. When the pouring nozzle must be replaced, it is then necessary to remove the blind plate and to replace it with a new nozzle. An emergency situation arising precisely at this moment generally results in a major incident since, before being able to interrupt the pouring by means of the blind plate, it is necessary to release the new nozzle from the guide system, to move it away from the pouring plant, to recover the blind plate, to arrange the latter on the guide system and to slide it into the closure position. Precious seconds are thus lost and may make it impossible to interrupt the sequence, the device having been damaged in the meantime or no longer being accessible to the operators.

The prior art (U.S. Pat. No. A1-5,494,201) has proposed a solution to this problem, consisting of providing the device with a system of additional guides (for example disposed perpendicular to the first guide rails, enabling the blind plate to be introduced at any time since, even at the precise moment of a replacement of a pouring nozzle, the blind plate is still in the standby position and ready to be slid into the closure position. Such a device is however relatively bulky and is therefore not suitable for all pouring plants.

It has also been suggested to use a pouring nozzle the plate of which constituting the upstream end has been extended in the opposite direction to the sliding direction, by a distance at least equal to the pouring hole. In this way, it is possible to close off the pouring channel by slightly pushing the pouring nozzle, a portion of said upstream plate of the pouring nozzle not having an orifice then coming in line with the orifice of the pouring channel provided in the bottom end of the inner nozzle. This development has not encountered significant commercial success since it requires extending the upstream plate of the pouring nozzle and consequently the stroke of the jack. It is consequently not applicable to plants where the space available under the tundish or in the ingot mould is restricted.

The emergency closure system normally used at the present time is therefore the blind plate with all the drawbacks dealt with above.

The industry is therefore still searching for an emergency closure system for a device for supplying and exchanging continuous casting nozzles that can be used in any plant and in particular in plant where the available space is limited. In addition, it would be necessary for this emergency closure system to be able to be used very rapidly at any time, in particular even at the time when the operator envisages replacing the pouring nozzle.

SUMMARY OF THE INVENTION

An object of the present invention is to provide a solution to these problems.

This problem is solved by means of a pouring nozzle comprising, at one end, referred to as the upstream end, a generally rectangular-shaped plate with a top surface and bottom surface, and a tube, the axis of the tube being substantially orthogonal to the top surface of the plate, the tube extending from the bottom surface of said plate to an opposite end of the nozzle, referred to as the downstream end. The nozzle comprises a pouring channel consisting of an inlet orifice formed through the surface of the plate, a bore in the plate, a bore in the tube, the downstream end of the tube being closed and the pouring channel emerging close to the downstream end through outlets provided in the lateral walls of the tube. The orifice in the plate, the bores in the plate and tube and the outlets are in fluid connection, the outlets being disposed symmetrically on either side of the axis of the tube, the centres of the outlets on either side of the axis defining an axis, referred to as the axis of the outlets, substantially orthogonal to the axis of the tube, the axis of the outlets being substantially parallel to a pair of sides of the plate. According to the invention, the inlet orifice is oblong and has a major axis and a minor axis, the minor axis of the orifice being parallel to the axis of the outlets and the pouring channel passes abruptly from an oblong cross section to a circular cross section.

It will be noted that it has already been proposed (see document GB-A-2160803) to use a sliding gate valve to control the flow of molten non-ferrous metal through a horizontal outlet comprising a sleeve or nozzle said sliding gate and nozzle being provided with an oblong orifice. This nozzle comprises at one end, referred to as the upstream end, a static, generally rectangular-shaped plate with a top surface and bottom surface, and a tube, the axis of the tube being substantially orthogonal to the top surface of the plate, the tube extending horizontally from one surface of said plate to an opposite end of the nozzle, referred to as the downstream end. The nozzle comprises a pouring channel consisting of an inlet orifice formed through the surface of the plate, a bore in the plate and a bore in the tube. The pouring channel of the nozzle has an oblong shape identical to that of the inlet orifice all along its length. The orifice in the plate, the bores in the plate and in the tube are in fluid connection. The downstream end of the nozzle is opened by an oblong outlet opening similar to the inlet opening so that the molten metal jet exiting from the downstream end directly plunges towards the mould. It is to be noted that such nozzles are intended for foundry applications for casting non-ferrous metal such as aluminium into casting mould. Such a nozzle could not be used for the continuous casting of molten steel from a tundish into a continuous casting mould. Indeed, the uncooled steel jet continuously emerging from the nozzle end portion and directly plunging towards the bottom end of the ingot mould would raise a serious security concern (risk of leakage). On the contrary, according to the present invention, the continuous casting nozzle is substantially vertical, has a closed downstream end, the pouring channel emerging close to the downstream end through outlets provided in the lateral walls of the tube.

In the context of the present invention, the largest dimension of the pouring orifice will be referred to by the term "major axis" and the largest dimension thereof in a direction perpendicular to the major axis will be referred by the term "minor axis", even if the "axes" in question are not axes of symmetry.

By virtue of this particular configuration of the orifice of the pouring channel in the top surface of the plate, it is possible to close off the pouring channel very rapidly by making the pouring nozzle slide so that part of the plate not having an orifice comes in line with the orifice of the pouring channel formed in the bottom end of the inner nozzle. For an identical pouring cross section of the orifice of the pouring channel, the shape of the orifice of the pouring channel reduces the distance to be travelled by the nozzle in order to pass from a total opening position to a total closure position. Consequently, at equal movement speeds and with identical cross sections, the closure of the pouring channel will be effected more rapidly than for a nozzle with a circular orifice as described above. The operator thus saves precious time for interrupting the pouring.

In addition, the fault that had led to the commercial rejection of the previous system, namely the need to extend the plate of the pouring nozzle and consequently the stroke of the jack and, ultimately, the bulk of the device, is greatly minimised since the oblong shape of the orifice does not require significant extension of the plate.

Advantageously, the major axis of the oblong orifice is off centre with respect to the sides of the rectangle perpendicular to the axis of the outlets. In this way the use of the surface of the plate is optimised. It is thus possible to close off the pouring channel even with a plate of reduced size. Generally, the plate is sized so as to leave sufficient safety margin between the pouring orifice and the periphery of the plate, between the pouring orifice and the area of the plate intended to close off the orifice in the inner nozzle and between this closure area and the periphery. In particular, it is recommended to leave a minimum distance of approximately 30 mm, preferably 40 mm, or even 50 mm between the periphery of the pouring orifice and the periphery of the plate. This distance may be less between the periphery of the orifice and the sides of the plate parallel to the axis of the outlets since the thrust exerted by the supplying and exchanging device (in particular the guide rails) on the pouring nozzle is generally distributed along its sides close to the pouring orifice. Thus a safety distance of 20 to 30 mm may suffice. Likewise, it will be sufficient to leave 5 to 20 mm between the pouring orifice and the area of the plate intended to close off the orifice in the inner nozzle and between this closure zone and the periphery. The plate itself will have to have a dimension in the direction corresponding to the outlet axis equal to twice the dimension of the minor axis of the orifice (in order to accept therein the pouring orifice and the closure area) increased by the safety margins. Advantageously, this dimension of the plate will therefore be at least three times the dimension of the minor axis of the orifice.

The oblong orifice can take any elongate shape, for example rectangular, oval, elliptical, arcs of a circle connected by straight-line segments, etc. From a purely geometrical point of view, the rectangular shape is the one that makes it possible to have the greatest cross section of flow for a given minor-axis dimension would be the most advantageous. However, for reasons of ease of manufacture, it is preferred to give it the form of arcs of a circle connected by straight-line segments. Even more advantageously, the pouring hole orifice will be shaped with two arcs of circles the radii of which are identical and correspond to twice the distance separating the centres, thereof connected by parallel straight-line segments. This shape can be visualised as a circle (the diameter of which perpendicular to the outlet axis corresponds to the major axis of the oblong orifice), the size of which will have been truncated along parallel chords (perpendicular to the outlet axis) the separation of which corresponds to the minor axis.

As indicated above, the pouring channel comprises the orifice in the plate, the bores in the plate and the tube and the outlets in fluid connection. It is therefore necessary to successively connect these various elements so that the jet that enters the oblong pouring orifice with a particular orientation emerges again from the outlets, which are oriented in a perpendicular direction. Various embodiments of the pouring channel allowing a change in orientation of the jet can be envisaged. This change in direction may be effected either abruptly, or progressively throughout the path of the liquid steel in the pouring channel. In the first case, it may be effected on first entry into the pouring nozzle or rather close to the outlets.

A study of the flow by the finite elements method has determined that it is highly advantageous to effect the transition very abruptly close to the inlet orifice of the pouring channel in the nozzle. According to the invention, the pouring channel passes abruptly (e.g., over a distance of between 20 and 50 mm as from the top surface of the upstream plate of the nozzle) from an oblong cross section to a circular cross section. The effect of this abrupt change is to partially compensate for the pressure drop caused by the passage of the steel through the pouring nozzle and which would tend to suck air through the surface joint between the inner nozzle and the pouring nozzle.

Preferably, the inner nozzle, which is the part directly upstream of the pouring nozzle according to the present invention, has an outlet orifice conformed so as to be substantially identical to the inlet orifice of the pouring channel in the nozzle in order to minimise disturbance to the flow of steel at the interface between these two pouring elements. Another object of the invention therefore relates to an assembly of the pouring nozzle according to the present invention and an inner nozzle, the inner nozzle comprising a plate at one end, referred to as the downstream end, provided with a discharge orifice, the seal between the pouring nozzle and the inner nozzle being effected by joining the downstream plate of the inner nozzle and the upstream plate of the pouring nozzle. According to this aspect of the invention, the discharge orifice of the inner nozzle is conformed in a substantially identical manner to the inlet orifice of the pouring channel in the pouring nozzle, so that, in the pouring position, the two orifices fluidly communicate.

BRIEF DESCRIPTION OF THE DRAWINGS

The invention will be better understood from a reading of the following description, solely given as an example and made with reference to the drawings, in which.

DETAILED DESCRIPTION OF THE INVENTION

Figure 1:
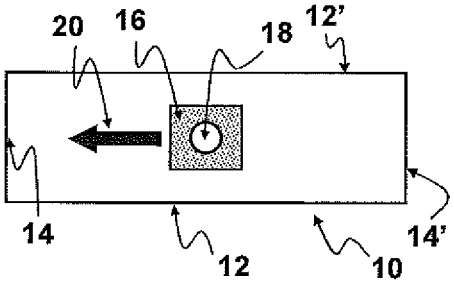
Fig. 1 Prior art
FIG. 1 is a schematic plan view of a continuous casting ingot mould comprising a pouring nozzle according to the prior art.
Figure 2:
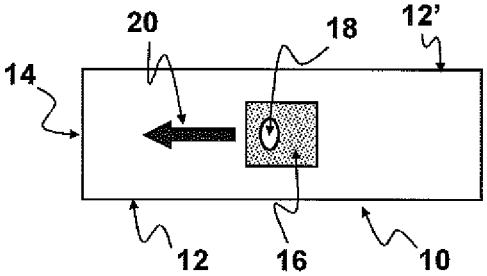
FIG. 2 is a schematic plan view of a continuous casting ingot mould comprising a pouring nozzle according to one embodiment of the invention.

An ingot mould 20, roughly rectangular in shape, having two long sides 12, 12' and two small sides 14, 14', can be seen schematically in FIGS. 1 and 2. At the centre of the ingot mould a pouring nozzle seen from above is shown, only the top surface 16 of which provided with a pouring orifice 18 can be seen. The details of the supplying and exchanging device are not visible in these figures. The direction 20 of sliding of the pouring nozzle in the nozzle supplying and exchanging device are also shown in each ingot mould. It will be noted that the discharge orifices of the pouring nozzle shown in FIGS. 1 and 2 are aligned in a direction parallel to the direction of sliding 20. Whereas the pouring orifice 18 of the nozzle known from the prior art (FIG. 1) is circular and centred with respect to the top surface 16, the pouring orifice 18 of the pouring nozzle according to the invention (FIG. 2) has an oblong shape. The orifice is elongate in a direction perpendicular to the direction 20 of sliding of the nozzle and therefore perpendicular to the direction of the outlets (not shown). This oblong orifice 18 is off centre in the direction 20 of sliding and is situated to the front of the plate in this direction.

Figure 3:
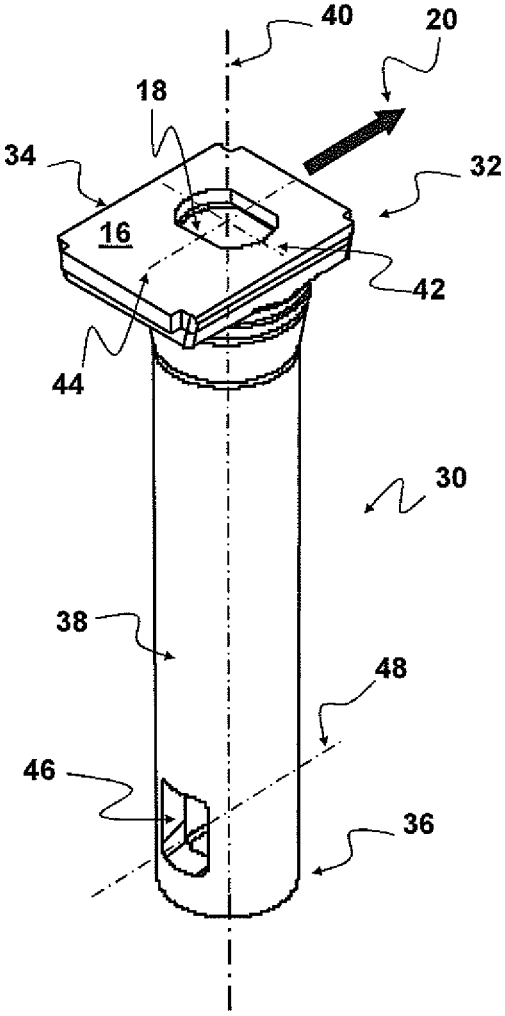
FIG. 3 is an isometric perspective view of a pouring nozzle according to one embodiment of the invention.
Figure 4:
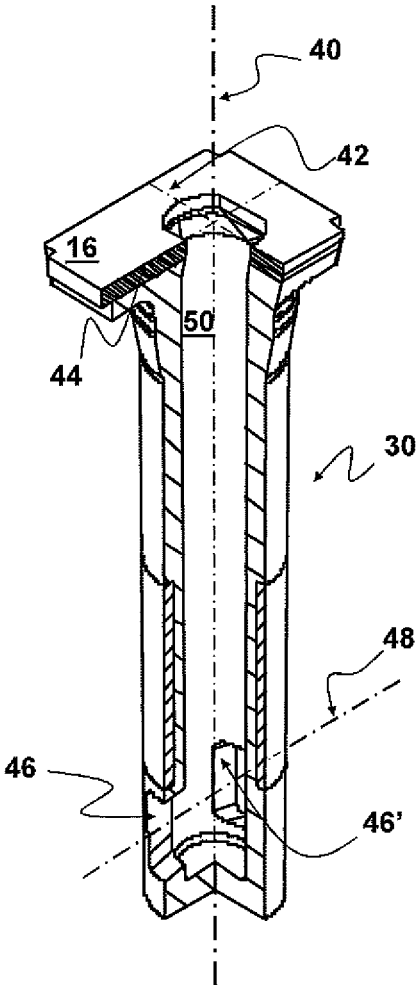
FIG. 4 is an isometric perspective view with a cross section of a pouring nozzle according to one embodiment of the invention.

FIGS. 3 and 4 show the details of a pouring nozzle 30 according to a particular embodiment of the invention. The two figures show the same pouring nozzle 30 comprising at its upstream end 32 a plate 34 roughly rectangular in shape with a top surface 16 and a bottom surface. The nozzle 30 also comprises a tube 38 the axis 40 of which is substantially orthogonal to the top surface 16 of the plate 34. The tube 38 extends from the bottom surface of the plate 34 to the downstream end 36 of the nozzle. The nozzle comprises a pouring channel consisting of the inlet orifice 18 provided through the surface 16 of the plate 34, a bore in the plate 34, a bore 50 in the tube 38; the downstream end 36 of the tube is closed and the pouring channel emerges close to the downstream end 36 through outlets 46, 46' provided in the lateral walls of the tube 38. The orifice of the plate 34, the bores in the plate and tube and the outlets being in fluid connection. The outlets 46, 46' are disposed symmetrically on either side of the axis 40 of the tube 38. The centres of the outlets 46, 46' on either side of the axis 40 define an axis of the outlets 48 substantially orthogonal to the axis defined by the pouring channel. The axis of the outlets is substantially parallel to a pair of sides of the plate 34. The orifice 18 is oblong and has a major axis 42 and minor axis 44. The minor axis 44 of the orifice 18 is parallel to the axis 48 of the outlets.

Numerous modifications and variations of the present invention are possible. It is, therefore, to be understood that within the scope of the following claims, the invention may be practiced otherwise than as specifically described.

The invention claimed is:

1. Pouring nozzle for the continuous casting of steel from a tundish towards a continuous casting mould comprising:

at one end, referred to as the upstream end, a generally rectangular-shaped plate with a top surface and a bottom surface, and a tube, the axis of the tube being substantially orthogonal to the top surface of the plate, extending from the bottom surface of the said plate to an opposite end of the nozzle, referred to as the downstream end, the nozzle comprising a pouring channel consisting of an inlet orifice formed through the surface of the plate, a bore in the plate, a bore in the tube, the downstream end of the tube being closed and the pouring channel emerging close to the downstream end through outlets formed in the lateral walls of the tube, the orifice in the plate, the bores in the plate and in the tube and the outlets being in fluid connection, the outlets being disposed symmetrically on either side of the axis of the tube, the centres of the outlets on either side of the axis defining an axis, referred to as the axis of the outlets, substantially orthogonal to the axis of the tube, the axis of the outlets being substantially parallel to a pair of sides of the plate wherein the inlet orifice is oblong and has a major axis and a minor axis, the minor axis of the orifice is parallel to the axis of the outlets, and wherein the pouring channel passes abruptly from an oblong cross section to a circular cross section.

2. Pouring nozzle according to claim 1, wherein the major axis of the oblong orifice is off centre with respect to the sides of the rectangle perpendicular to the axis of the outlets.

3. Pouring nozzle according to claim 1, wherein the dimension of the plate in the direction corresponding to the axis of the outlets is equal to at least three times the dimension of the minor axis of the orifice.

4. Pouring nozzle according to claim 1, wherein the oblong orifice is conformed in two arcs of circles the radii of which are identical and correspond to twice the distance separating the centres thereof connected by parallel straight-line segments, with identical lengths and perpendicular to the axis of the outlets.

5. Pouring nozzle according to claim 1, wherein the abrupt passage of the pouring channel from an oblong cross section to a circular cross section occurs over a distance of between 20 and 50 mm as from the top surface of the plate.

6. Pouring nozzle according to claim 5, wherein the change in cross section is accompanied by a reduction in the cross section of flow.

7. Assembly of a pouring nozzle according to claim 1 and an inner nozzle, the inner nozzle comprising a plate at one end, referred to as the downstream end, provided with a discharge orifice, the seal between the pouring nozzle and the inner nozzle being effected by a joint between the downstream plate of the inner nozzle and the upstream plate of the pouring nozzle.

8. Assembly of a pouring nozzle according to claim 7 wherein the discharge orifice of the inner nozzle is conformed in a substantially identical manner to the inlet orifice of the pouring channel in the pouring nozzle so that, in the pouring position, the two orifices communicate fluidly.

* * * * *